US005122290A

United States Patent [19]

Barwise

[11] Patent Number: 5,122,290

[45] Date of Patent: Jun. 16, 1992

[54] FROTH FLOTATION OF CALCIUM BORATE MINERALS

[75] Inventor: Christopher H. Barwise, Fordingbridge, England

[73] Assignee: Fospur Limited, Derby, England

[21] Appl. No.: 651,608

[22] Filed: Feb. 6, 1991

Related U.S. Application Data

[62] Division of Ser. No. 516,188, Apr. 30, 1990.

[30] Foreign Application Priority Data

Jul. 29, 1989 [GB] United Kingdom ..... 8917426

[51] Int. Cl.[5] ..... B03D 1/012; B03D 1/008; B03D 1/02

[52] U.S. Cl. ..... 252/61; 209/166

[58] Field of Search ..... 252/61; 209/166, 167

[56] References Cited

U.S. PATENT DOCUMENTS

| | | | |
|---|---|---|---|
| 1,370,366 | 3/1921 | Sayre | 209/166 |
| 2,184,558 | 11/1939 | Malozemoff et al. | 209/166 |
| 2,317,413 | 3/1943 | Shelton | 209/166 |
| 3,635,338 | 1/1972 | Chemtob et al. | 209/166 |
| 3,917,801 | 9/1975 | Wilson | 209/167 |
| 4,139,481 | 1/1979 | Wang et al. | 252/61 |
| 4,158,623 | 5/1979 | Wang et al. | 209/166 |
| 4,196,092 | 7/1980 | Wang et al. | 252/61 |
| 4,199,065 | 1/1980 | Wang et al. | 209/166 |
| 4,317,543 | 3/1982 | Olivares | 241/16 |
| 4,510,048 | 4/1985 | Mai | 209/166 |
| 4,510,049 | 4/1985 | Mai et al. | 209/3 |
| 4,790,931 | 12/1988 | Koester et al. | 209/166 |
| 4,814,070 | 3/1989 | Koester et al. | 209/166 |

FOREIGN PATENT DOCUMENTS

| | | | |
|---|---|---|---|
| 1201223 | 2/1986 | Canada | 209/166 |
| 150154 | 8/1981 | German Democratic Rep. | 209/166 |
| 1360802 | 12/1987 | U.S.S.R. | 209/166 |

*Primary Examiner*—Stanley S. Silverman
*Assistant Examiner*—Thomas M. Lithgow
*Attorney, Agent, or Firm*—Nixon & VanDerhye

[57] ABSTRACT

Particles of a calcium borate mineral, such as colemanite or ulexite, are recovered from an ore by a froth flotation process using a dialkyl sulphosuccinate as collector. Suitable dialkyl sulphosuccinates include sodium or ammonium dinonyl sulphosuccinate, sodium or ammonium di-isodecyl sulphosuccinate, and sodium or ammonium dilauryl sulphosuccinate. The dialkyl sulphosuccinates may be used as aqueous solutions or as solutions in solvents consisting of water and methylated spirit, a dihydric alcohol such as ethylene glycol or hexylene glycol or a monohydric alcohol containing more than 5 carbons.

6 Claims, No Drawings

FROTH FLOTATION OF CALCIUM BORATE MINERALS

This is a division of application Ser. No. 07/516,188, filed Apr. 30, 1990.

This invention relates to the froth flotation of calcium borate minerals, particularly colemanite and ulexite minerals.

Froth flotation is a commonly used process of separating desired mineral particles from unwanted mineral particles such as silica, silicates and other similar materials, or of separating particles of one desired mineral from those of another desired mineral. A surface active chemical compound, known as a "collector", is added to an aqueous suspension of the ore particles so as to render the particles of a desired mineral hydrophobic and capable of being separated from particles of another desired mineral or of undesired minerals. A so-called "frother" is added to the suspension and the suspension is then aerated. The air bubbles adhere selectively to the particles of the desired mineral, the particles float to the surface to form a froth which overflows into a launder, and the desired mineral is thus separated.

Calcium borate minerals such as colemanite and ulexite are often recovered from their ores by froth flotation using as collector akyl-aryl sulphonates or, as described in U.S. Pat. No. 4,510,049, anionic petroleum sulphonates. However such collectors are not sufficiently selective for the calcium borate minerals and there is a tendency for unwanted minerals such as clay slimes, gypsum and other calcium minerals to be recovered in the froth flotation process as well.

It has now been found that calcium borate minerals can be recovered more selectively using a dialkyl sulphosuccinate as the collector in the froth flotation process.

According to the invention there is provided a process for the recovery of a calcium borate mineral from an ore comprising adding to an aqueous slurry of particles of the ore a collector comprising a dialkyl sulphosuccinate, and subjecting the calcium borate particles to flotation in a froth flotation cell.

It is essential that each molecule of dialkyl sulphosuccinate contains two alkyl hydrocarbon chains in order to achieve the desired selectivity for floating of the calcium borate mineral.

Each alkyl group may contain for example between 6 and 18 carbon atoms. Preferably each alkyl group contains 8 to 14 carbon atoms.

Although the principal function of the dialkyl sulphosuccinate is that of a collector the dialkyl sulphosuccinate may also act as a frother. When long carbon chain dialkyl sulphosuccinates are used as the collector a frother may need to be used.

Suitable dialkyl sulphosuccinates include sodium or ammonium dinonyl sulphosuccinate, sodium or ammonium di-isodecyl sulphosuccinate and sodium or ammonium dilauryl sulphosuccinate.

Sodium or ammonium dialkyl sulphosuccinates are commercially available as water based pastes, containing up to about 50% by weight of the sulphosuccinate and these pastes can be further diluted with water for use in the process of the invention.

Sodium or ammonium dialkyl sulphosuccinates are also commercially available as solutions in water and industrial methylated spirit, for example solutions containing 60–70% by weight dialkyl sulphosuccinate, 5–15% by weight water and 15–25% by weight industrial methylated spirit. As the industrial methylated spirit reduces the viscosity of the solution it enables a higher concentration of dialkyl sulphosuccinate to be used.

The dialkyl sulphosuccinates may also be used in the process of the invention as solutions in solvents consisting of water and either a dihydric alcohol such as ethylene glycol or hexylene glycol, or a monohydric alcohol containing more than 5 carbon atoms.

According therefore to a further feature of the invention there is provided a collector composition for use in the froth flotation of calcium borate minerals the composition comprising a dialkyl sulphosuccinate, water and a dihydric alcohol or a monohydric alcohol containing more than 5 carbon atoms.

Usually the collector composition will contain 50–80% by weight dialkyl sulphosuccinate, 2–30% by weight water and 10–40% by weight dihydric alcohol or monohydric alcohol containing more than 5 carbon atoms.

The quantity of the collector composition used in the process of the invention will usually be in the range 300–1500 g/tonne of feed ore, i.e. calcium borate minerals and unwanted minerals, to be subjected to froth flotation.

The collector composition and process of the invention enable a better separation to be made between the calcium borate minerals which are required in a concentrate and the waste minerals which are not wanted, compared with known collectors and processes.

The following example will serve to illustrate the invention.

Three froth flotation tests were carried out on a colemanite ore from Turkey.

The ore contained approximately 74% by weight colemanite and had been scrubbed, deslimed to remove clay, and ground to pass a 250 micron screen. In each test prior to the addition of a collector 447.5 g of ground ore containing 10.06% by weight moisture was decanted three times in a 2.2 liters Denver cell in order to remove the slimes created during grinding. The critical terminal viscosity for decantation was calculated as 0.75 mm per second.

The ore particles were then washed into a 1.1 liters Denver cell with soft water, and the resulting pulp was made up to 22% by weight solids with soft water. The temperature of the pulp in each test was between 13.25° C. and 14.5° C.

In the first test the collector used was a 1:2 by weight mixture of low molecular weight and medium molecular weight petroleum sulphonates similar to those specified in U.S. Pat. No. 4,510,049. In the second test the collector used was a composition consisting of 70% by weight ammonium dinonyl sulphosuccinate, 20% by weight hexylene glycol and 10% by weight water and in the third test the collector used was a composition consisting of 70% by weight of a 90:10 by weight mixture of sodium di-isodecyl sulphosuccinate and ammonium dinonyl sulphosuccinate, 20% by weight methylated spirit and 10% by weight water.

In test 1 3.6 ml of a 10% by weight aqueous solution of the collector was used and in tests 2 and 3 9.1 ml of a 5% by weight aqueous solution of the collector composition was used. The collectors were added to the ore pulp in the 1.1 liters Denver cell and the pulp was conditioned by means of agitation for 5 minutes. No separate frother was added. Flotation was commenced and a rougher froth was taken off for 4.5 minutes in tests 1 and 2 and for 5 minutes in test 3. The pulp remaining in the cell was discharged as a tailing product. The rougher froths were then returned to the same cell and cleaned for 3.5 minutes in tests 1 and 2 and for 4.75 minutes in test 3.

The results obtained are tabulated below:

| PRODUCT | WEIGHT (g) | WEIGHT % | ASSAY (WT %) BORIC OXIDE | ASSAY (WT %) COLEMANITE | DISTRIBUTION (WT %) |
|---|---|---|---|---|---|
| TEST 1 | | | | | |
| SLIMES | 113.5 | 28.3 | 31.8 | 62.5 | 24.0 |
| CONCENTRATE | 198.5 | 49.5 | 46.8 | 92.0 | 61.7 |
| CLEANER TAIL | 29.0 | 7.3 | 26.3 | 51.7 | 5.1 |
| TAILING | 59.8 | 14.9 | 23.2 | 45.6 | 9.2 |
| TOTAL | 400.8 | 100.0 | 37.5 | 73.9 | 100.0 |
| TEST 2 | | | | | |
| SLIMES | 117.5 | 29.2 | 31.8 | 62.5 | 24.7 |
| CONCENTRATE | 192.5 | 47.8 | 49.7 | 97.75 | 63.3 |
| CLEANER TAIL | 14.25 | 3.6 | 21.7 | 42.7 | 2.1 |
| TAILING | 78.25 | 19.4 | 19.1 | 37.6 | 9.9 |
| TOTAL | 402.5 | 100.0 | 37.5 | 73.9 | 100.0 |
| TEST 3 | | | | | |
| SLIMES | 114.0 | 28.6 | 32.1 | 63.1 | 24.3 |
| CONCENTRATE | 205.75 | 51.5 | 48.1 | 94.6 | 65.6 |
| CLEANER TAIL | 17.4 | 4.4 | 21.6 | 42.5 | 2.5 |
| TAILING | 62.0 | 15.5 | 18.6 | 36.6 | 7.6 |
| TOTAL | 399.15 | 100.0 | 37.8 | 74.4 | 100.0 |

In test 1 the total of concentrate and cleaner tail which corresponds to the original rougher froth contained 44.2% by weight boric oxide (87.0% by weight colemanite) at a recovery of 66.8%. In test 2 the total of concentrate and cleaner tail contained 47.7% by weight boric oxide (93.9% by weight colemanite) at a recovery of 65.4%. In test 3 the total of concentrate and cleaner tail contained 40.0% by weight boric oxide (90.6% by weight colemanite) at a recovery of 68.1%.

Although the dialkyl sulphosuccinates are not as powerful as the petroleum sulphonates as collectors and they need to be used in greater amounts, they are much more selective, and thus give better grade concentrates and higher recoveries of colemanite. The collector composition used in test 2 gave 5.75% by weight more colemanite in the concentrate with 1.6% higher recovery than the petroleum sulphonates in test 1. Similarly in test 3 the collector composition gave 2.6% by weight more colemanite in the concentrate and 4.9% higher recovery than the petroleum sulphonates in test 1.

The results also show that the weight and boron distribution in the cleaner tailing of test 1 were greater due to the poor selectivity of the petroleum sulphonates. Such inferior selectivity will often cause build-up of recirculating material in continuous froth flotation processes.

I claim:

1. A collector composition for use in the recovery of a calcium borate mineral from an ore by froth flotation of an aqueous slurry of particles of the ore, said composition comprising 50–80% by weight of a dialkylsulphosuccinate, 2–30% by weight of water and 10–40% by weight of a dihydric alcohol or a monohydric alcohol containing more than 5 carbon atoms.

2. A collector composition according to claim 1 wherein the dialkyl sulphosuccinate contains 6 to 18 carbon atoms in each alkyl group.

3. A collector composition according to claim 2 wherein the dialkyl sulphosuccinate contains 8 to 14 carbon atoms in each alkyl group.

4. A collector composition according to claim 3 wherein the dialkyl sulphosuccinate is sodium dinonyl sulphosuccinate, ammonium dinonyl sulphosuccinate, sodium di-isodecyl sulphosuccinate, ammonium diisodecyl sulphosuccinate, sodium dilauryl sulphosuccinate or ammonium dilauryl sulphosuccinate.

5. A collector composition according to claim 1 wherein the dihydric alcohol is ethylene glycol or hexylene glycol.

6. A collector composition according to claim 1 in which the dialkyl sulphosuccinate is a mixture of sodium di-isodecyl sulphosuccinate and ammonium dinonyl sulphosuccinate.

* * * * *